US010323452B2

(12) United States Patent
Kwak et al.

(10) Patent No.: US 10,323,452 B2
(45) Date of Patent: Jun. 18, 2019

(54) ACTUATOR ACTIVATION BASED ON SENSED USER CHARACTERISTICS

(71) Applicant: EMPIRE TECHNOLOGY DEVELOPMENT LLC, Wilmington, DE (US)

(72) Inventors: Jin Sam Kwak, Uiwang-si (KR); Geonjung Ko, Suwon-si (KR); Min Seok Noh, Seoul (KR); Hyun Oh Oh, Seongnam-si (KR); Ju Hyung Son, Uiwang-si (KR)

(73) Assignee: Empire Technology Development LLC, Wilmington, DE (US)

( * ) Notice: Subject to any disclaimer, the term of this patent is extended or adjusted under 35 U.S.C. 154(b) by 311 days.

(21) Appl. No.: 15/218,160

(22) Filed: Jul. 25, 2016

(65) Prior Publication Data

US 2018/0023334 A1 Jan. 25, 2018

(51) Int. Cl.
*E05F 15/76* (2015.01)
*G07C 9/00* (2006.01)

(52) U.S. Cl.
CPC ..... *E05F 15/76* (2015.01); *G07C 9/00309* (2013.01); *G07C 2209/64* (2013.01)

(58) Field of Classification Search
CPC ..... G07C 9/00309
USPC ..... 701/49; 340/5.72
See application file for complete search history.

(56) References Cited

U.S. PATENT DOCUMENTS

2005/0168322 A1 8/2005 Appenrodt et al.
2007/0205863 A1 9/2007 Eberhard
2008/0068145 A1 3/2008 Weghaus et al.
2009/0177437 A1* 7/2009 Roumeliotis ..... G01C 21/12 702/150
2014/0298434 A1* 10/2014 Prchal ..... H04W 4/026 726/7

(Continued)

FOREIGN PATENT DOCUMENTS

WO 2002025040 A1 3/2002

OTHER PUBLICATIONS

"Better Convenience through Smart Caring," accessed at https://web.archive.org/web/20150924231829/http://brand.hyundai.com/en/challenge/for-technology/more-smart-convenience.do, accessed on May 20, 2016, pp. 3.

(Continued)

*Primary Examiner* — Vernal U Brown
(74) *Attorney, Agent, or Firm* — Christensen O'Connor Johnson Kindness PLLC

(57) ABSTRACT

Technologies are generally described for activation of actuators based on sensed user characteristics, such as orientation. In some examples, an access control system may be configured to activate an actuator upon determining that an activation device is both in proximity to and has a similar orientation to the actuator. The access control system may be configured to determine orientation similarity by determining an orientation associated with the activation device, determining an orientation associated with the actuator, and comparing a difference between the two orientations to an activation threshold. The actuator may be associated with an entryway such as a building doorway, a room doorway, or a vehicle door, or may be associated with a container such as a safe or vehicle trunk.

21 Claims, 10 Drawing Sheets

(56) References Cited

U.S. PATENT DOCUMENTS

| | | | | |
|---|---|---|---|---|
| 2015/0025751 | A1* | 1/2015 | Sugiura | B60J 5/06 701/49 |
| 2015/0316576 | A1* | 11/2015 | Pakzad | G01P 13/00 702/141 |
| 2017/0198496 | A1* | 7/2017 | Beck | E05B 17/22 |

OTHER PUBLICATIONS

Demuro, D., "Hyundai's Hands-Free Liftgate System Is Laughably Bad," accessed at https://web.archive.org/web/20151117023531/http://jalopnik.com/hyundai-s-hands-free-liftgate-system-is-laughably-bad-1721761658, Posted on Aug. 3, 2015, pp. 4.

* cited by examiner

ACTUATOR ACTIVATION BASED ON SENSED USER CHARACTERISTICS

BACKGROUND

Unless otherwise indicated herein, the materials described in this section are not prior art to the claims in this application and are not admitted to be prior art by inclusion in this section.

A human-computer interface or user interface (UI) allows a user to interact with an electronic computer. In general, user interface implementations may be based on converting some natural human action into computer input. For example, a keyboard, a mouse, a stylus, or a touchscreen may be used to convert user hand movements into computer input. A microphone may be used to convert user speech into computer input, a camera may be used to convert user eye or body movements into computer input, and a proximity detection system may be used to convert user proximity into computer input.

SUMMARY

The present disclosure generally describes techniques to activate actuators based on sensed orientation parameters.

According to some examples, a method is provided to activate an opening mechanism. The method may include measuring a first orientation parameter using a sensor, measuring a second orientation parameter associated with the opening mechanism, and determining a difference between the first orientation parameter and the second orientation parameter. The method may further include determining that the sensor and the opening mechanism are in proximity and activating the opening mechanism in response to determination that the difference satisfies an activation threshold and determination that the sensor and the opening mechanism are in proximity.

According to other examples, an actuator activation system is provided to activate an actuator based on sensed orientation parameters. The system may include an actuator, an interface configured to communicate with a sensor, and a processor block coupled to the actuator and the interface. The processor block may be configured to receive a first orientation parameter from the sensor, measure a second orientation parameter associated with the actuator, and determine a difference between the first orientation parameter and the second orientation parameter. The processor block may be further configured to determine that the sensor and the actuator are in proximity and activate the actuator in response to determination that the difference satisfies an activation threshold and determination that the sensor and the actuator are in proximity.

According to further examples, another actuator activation system is provided to activate an actuator based on sensed orientation parameters. The system may include an interface configured to communicate with an actuator controller, a sensor configured to measure a first orientation parameter associated with the sensor, and a processor block coupled to the interface and the sensor. The processor block may be configured to receive a proximity detection signal from the actuator controller, receive a second orientation parameter from the actuator controller, and determine a difference between the first orientation parameter and the second orientation parameter. The processor block may be further configured to transmit an activation signal to the actuator controller in response to receiving the proximity detection signal and determination that the difference satisfies an activation threshold.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
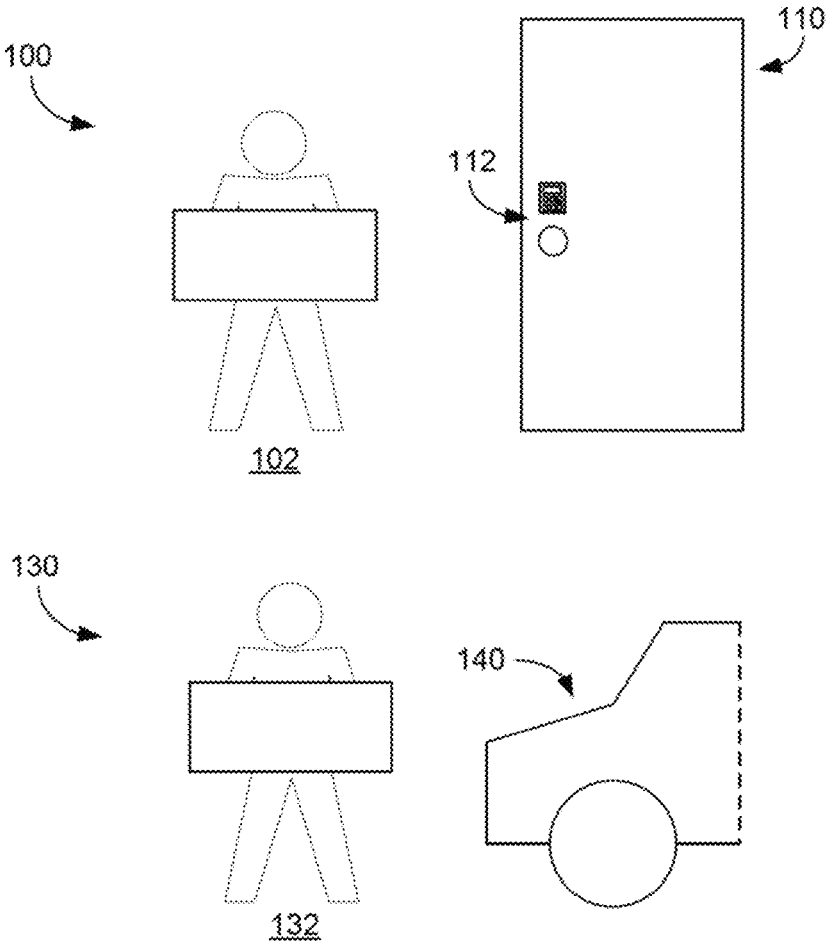
FIG. 1 PRIOR ART
FIG. 1 illustrates how certain user interfaces may not be available in particular situations.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and/or computer program products related to activation of actuators based on sensed user characteristics.

Briefly stated, technologies are generally described for activation of actuators based on sensed user characteristics, such as orientation. In some examples, an access control system may be configured to activate an actuator upon determining that an activation device is both in proximity to and has a similar orientation to the actuator. The access control system may be configured to determine orientation similarity by determining an orientation associated with the activation device, determining an orientation associated with the actuator, and comparing a difference between the two orientations to an activation threshold. The actuator may be associated with an entryway such as a building entry door, a room doorway, or a vehicle door, or may be associated with a container such as a safe or vehicle trunk.

FIG. 1 illustrates how certain user interfaces may not be available in particular situations.

As described above, UI implementations may be based on converting some action, such as, by way of example, natural human or animal action into computer input. For example, different types of UIs may convert human hand movements, human speech, human eye movements, and/or human body movements or gestures into inputs. Although many different types of human actions may be used as the basis for a UI, hand-based UIs may be preferred in some cases. Such interfaces may include keyboards or keypads, mice or other discrete pointing devices, touchscreens, and gesture-sensing interfaces.

In some situations, a certain UI type may be temporarily unavailable. For example, a first diagram 100 depicts a user 102 carrying an object who wishes to open a door 110. The door 110 may be equipped with an electronic entry system 112 configured with a hand-based UI. However, the user 102 may be unable to conveniently use the hand-based UI because of the carried item (i.e., the user's hands are carrying the item and not available to use the hand-based UI). Accordingly, the user 102 may need to drop the item or place the item elsewhere in order to use the hand-based UI of the entry system 112.

A second diagram 130 depicts another situation in which a certain UI type is temporarily unavailable. A user 132, carrying an object, may wish to open a storage compartment 140 of a vehicle. The compartment 140, similar to the door 110, may be equipped with an electronic opening mechanism configured to respond to a hand-based UI. For example, the compartment 140 may open when a user presses a button on the compartment 140, or when a user manually actuates a remote controller. However, similar to the user 102, the user 132 may be unable to conveniently open the compartment 140 because of the carried object.

Figure 2:
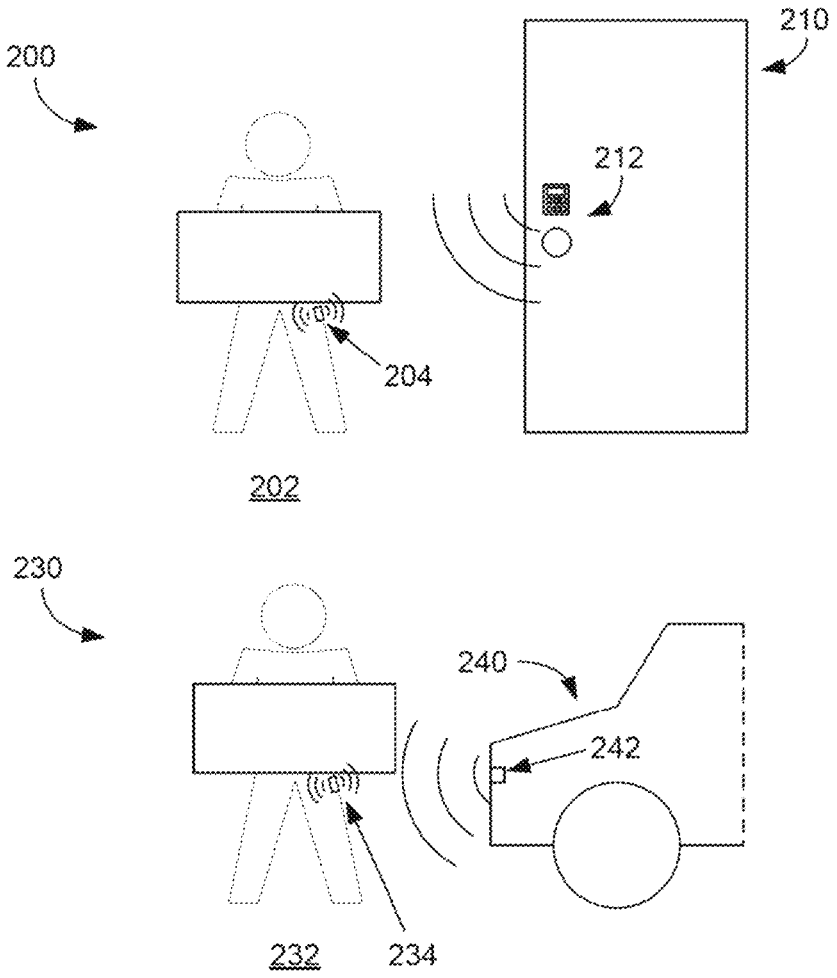
FIG. 2 PRIOR ART
FIG. 2 illustrates how a proximity user interface may be used in situations where other user interfaces are unavailable.

FIG. 2 illustrates how a proximity user interface may be used in situations where other user interfaces are unavailable.

In some situations, a UI system may treat user proximity as a user input. As depicted in a first diagram 200, which is similar to the first diagram 100, a user 202 carrying an object may wish to open a door 210. The door 210 may be equipped with an electronic entry system 212 configured with a hand-based UI. Differently from the first diagram 100, the user 202 may have a proximity UI device 204, and the electronic entry system 212 may also be configured to respond to the proximity UI device 204. For example, the proximity UI device 204 may include a proximity sensor configured to communicate with the electronic entry system 212, similar to remote keyless entry systems. Because the user 202 may be unable to use the hand-based UI of the electronic entry system 212 while carrying the object, the user 202 may instead use the proximity UI device 204 to operate the electronic entry system 212, thereby causing the door 210 to open. For example, the user 202 may approach the door 210 and the electronic entry system 212. Upon determining that the proximity UI device 204 is within a particular range of the door 210 or the electronic entry system 212, the electronic entry system 212 may cause the door 210 to open.

A second diagram 230 depicts another situation in which a user 232 carrying an object may be attempting to open a storage compartment 240 of a vehicle. The user 232, similar to the user 202, may also have a proximity UI device 234, such as a proximity sensor as described above. The storage compartment 240 may be equipped with an electronic opening mechanism configured to open the storage compartment 240 in response to both to a hand-based UI and to the proximity UI device 234 via a sensor 242. As in the first diagram 200, because the user 232 may be unable to use the hand-based UI of the electronic opening mechanism while carrying the object, the user may instead use the proximity UI device 234 to actuate the storage compartment 240.

While using proximity as the only trigger for actuation of an entryway or container is suitable in some situations, in other situations additional triggers may be used to reduce the occurrence of false triggers. For example, a vehicle trunk door may be configured to actuate upon determining that a proximity UI device is in proximity. When a user carrying the proximity UI device walks past the vehicle, the vehicle trunk door may detect the presence of the UI device and automatically actuate, even if the user did not actually intend to have the vehicle trunk door actuate. Accordingly, in some embodiments an entryway or container controller may determine whether to actuate the entryway or container based on some other characteristic or parameter in addition to proximity. For example, a controller may use orientations associated with a user, a container, an entryway, and/or an actuator in addition to proximity in order to determine whether actuation should occur.

Figure 3:
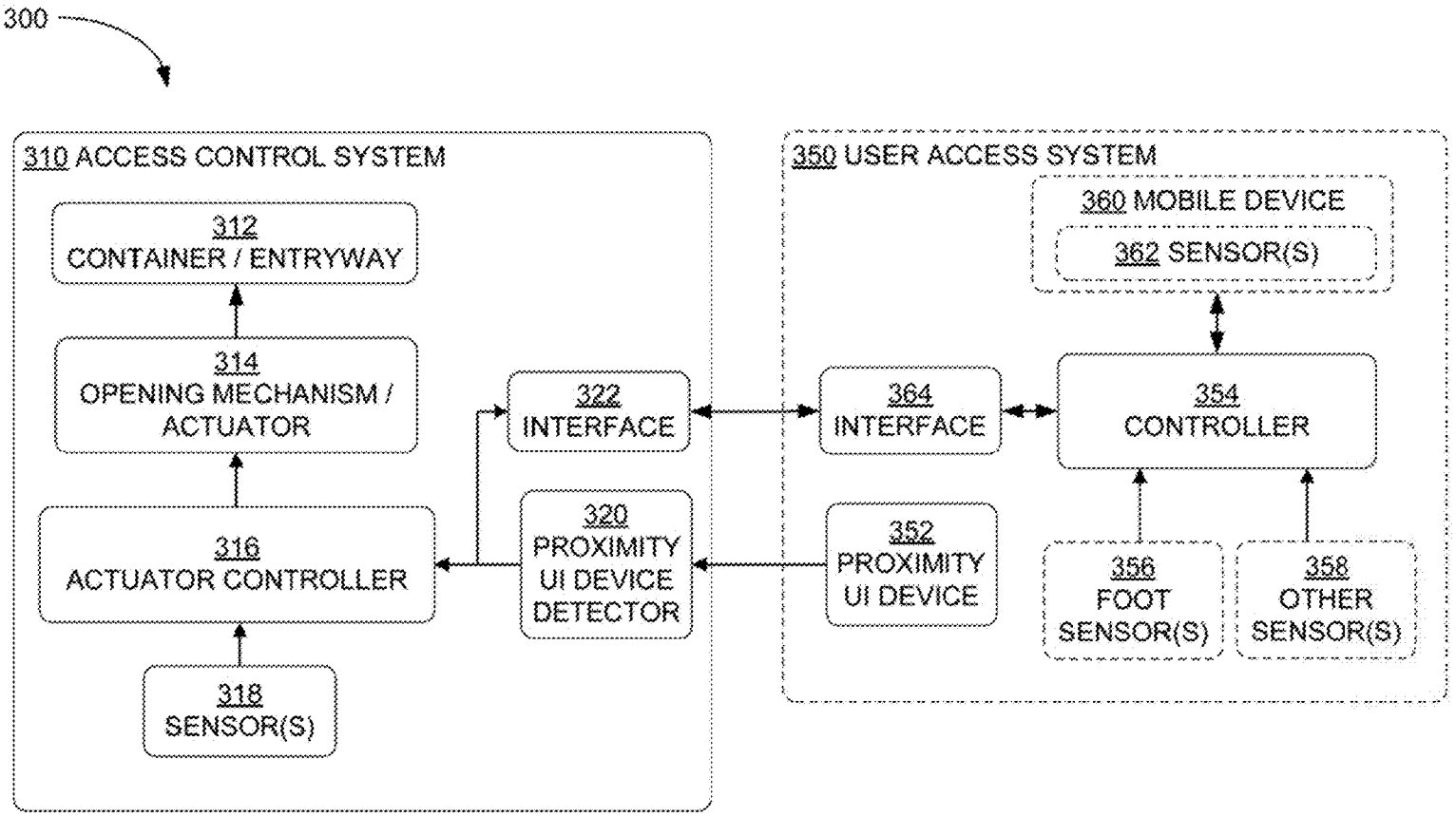
FIG. 3 illustrates an example system where sensed orientation parameters may be used to activate an actuator.

FIG. 3 illustrates an example system where sensed orientation parameters may be used to activate an actuator, arranged in accordance with at least some embodiments described herein.

According to a diagram 300, an access control system 310 may be configured to communicate with a user access system 350 in order to determine whether access to a container or entryway 312 should be provided. The access control system 310 may be implemented in a vehicle or structure having container/entryway 312. In some embodiments, the container/entryway 312 may include a vehicle door, a vehicle trunk, and/or a vehicle tailgate (for example, the gate of a pickup truck or similar). In other embodiments, the container/entryway 312 may be associated with a building or structure, and include a gate, an entrance door, a room door, or similar. The container/entryway 312 may also include a container such as a box, safe, locker, cabinet, storage compartment, or any suitable container that can be opened.

In addition to the container/entryway 312, the access control system 310 may include an opening mechanism or actuator 314 configured to actuate (for example, open, close, unlock, or lock) the container/entryway 312. The actuator 314 may be located at or near the container/entryway 312, or may be located away from but still be configured to actuate the container/entryway 132. The access control system 310 may also include an actuator controller 316 coupled to the actuator 314 and configured to cause the actuator 314 to actuate the container/entryway 312. The user access system 350, which may be associated with an individual user, may include a proximity UI device 352. When the user access system 350 approaches the access control system 310, the proximity UI device 352 may communicate with a proximity UI device detector 320, which may then report the presence of the proximity UI device 352 to the actuator controller 316 in order to cause the actuation of the container/entryway 312. The proximity UI device detector 320 may be located near the container/entryway 312 and/or near the actuator 314.

In some embodiments, detection of the proximity UI device 352 may not be sufficient for the actuator controller 316 to cause the actuator 314 to actuate the container/entryway 312. For example, the actuator controller 316 may also require that a first sensed parameter associated with the access control system 310 and a second sensed parameter associated with the user access system 350 substantially correspond before causing the actuator 314 to actuate the container/entryway 312. Accordingly, the access control system 310 may include one or more sensors 318 configured to measure some particular characteristic or parameter associated with the system 310 and provide the measurements to the actuator controller 316. For example, the sensor(s) 318 may implement a digital compass and/or a magnetometer, and may be configured to measure an orientation parameter associated with the system 310 and/or the container/entryway 312 and provide the measured orientation parameter to the actuator controller 316. For example, the orientation parameter may include an orientation of the system 310, an orientation of the container/entryway 312, an orientation of an opening or an access route associated with the container/entryway 312, an orientation associated with an individual component of the system 310, or any other suitable orientation associated with the system 310. The access control system 310 may further include an interface 322 configured to communicate with the user access system 350, for example to exchange sensor information with the user access system 350.

The user access system 350, in turn, may also include sensors configured to measure the particular characteristic or parameter associated with the user access system 350. For example, the user access system 350 may include one or more foot sensors 356, one or more other sensors 358, and/or a mobile device 360 implementing one or more sensors 362. The foot sensors 356, the other sensors 358, and/or the sensors 362 may be configured to measure characteristics or parameters associated with the user access system 350, such as an orientation parameter associated with the user access system 350, a user of the system 350, and/or the proximity UI device. For example, the foot sensor(s) 356 may include one or more insole, plantar, and/or shoe sensors integrated into shoes, sandals, boots, socks, or other footwear, and may be configured to sense information about a user's weight, weight distribution, foot orientation, and/or foot movement. In some embodiments, the foot sensor(s) 356 may be configured to detect user feet orientation and calculate a user orientation parameter based on the user feet orientation. The foot sensor(s) 356 may calculate the user orientation parameter based on historical relationships between feet orientation and user orientation, based on one or more algorithms associating feet orientation and user orientation, some other method, or a combination of the previous. The other sensors 358 may include other body sensors configured to detect a characteristic or parameter of a user of the user access system 350, such as user body movements and/or user body orientations. The sensors 362 may be configured to sense information about the orientation and/or movement of the mobile device 360, which in turn may be correlated to the orientation and/or movement of a user of the user access system 350. In some embodiments, one or more of the foot sensors 356, the other sensors 358, and/or the sensors 362 may implement a digital compass and/or a magnetometer, similar to the sensors 318.

The foot sensors 356, the other sensors 358, and/or the mobile device 360 may be configured to provide the sensed parameter information to a controller 354, which in turn may be configured to communicate with the access control system 310 via an interface 364. For example, the controller 354 may transmit sensed parameter information to the access control system 310 in order to cause the actuation of the container/entryway 312. The interface 364 may be configured to communicate with the interface 322 of the access control system 310, for example via wireless signals such as Bluetooth signals, WiFi signals, other RF signals, optical signals, infrared signals, or any other suitable wireless signaling method.

In some embodiments, the controller 354 instead of the actuator controller 316 may perform the determination of whether conditions have been satisfied for actuation of the container/entryway 312. In this case, the controller 354 may receive sensed parameter information from the access control system 310 and determine whether the received sensed parameter information substantially corresponds to sensed parameter information associated with the user access system 350. If the information substantially corresponds, then the controller 354 may transmit an actuator activation signal to the access control system 310.

Figure 4:
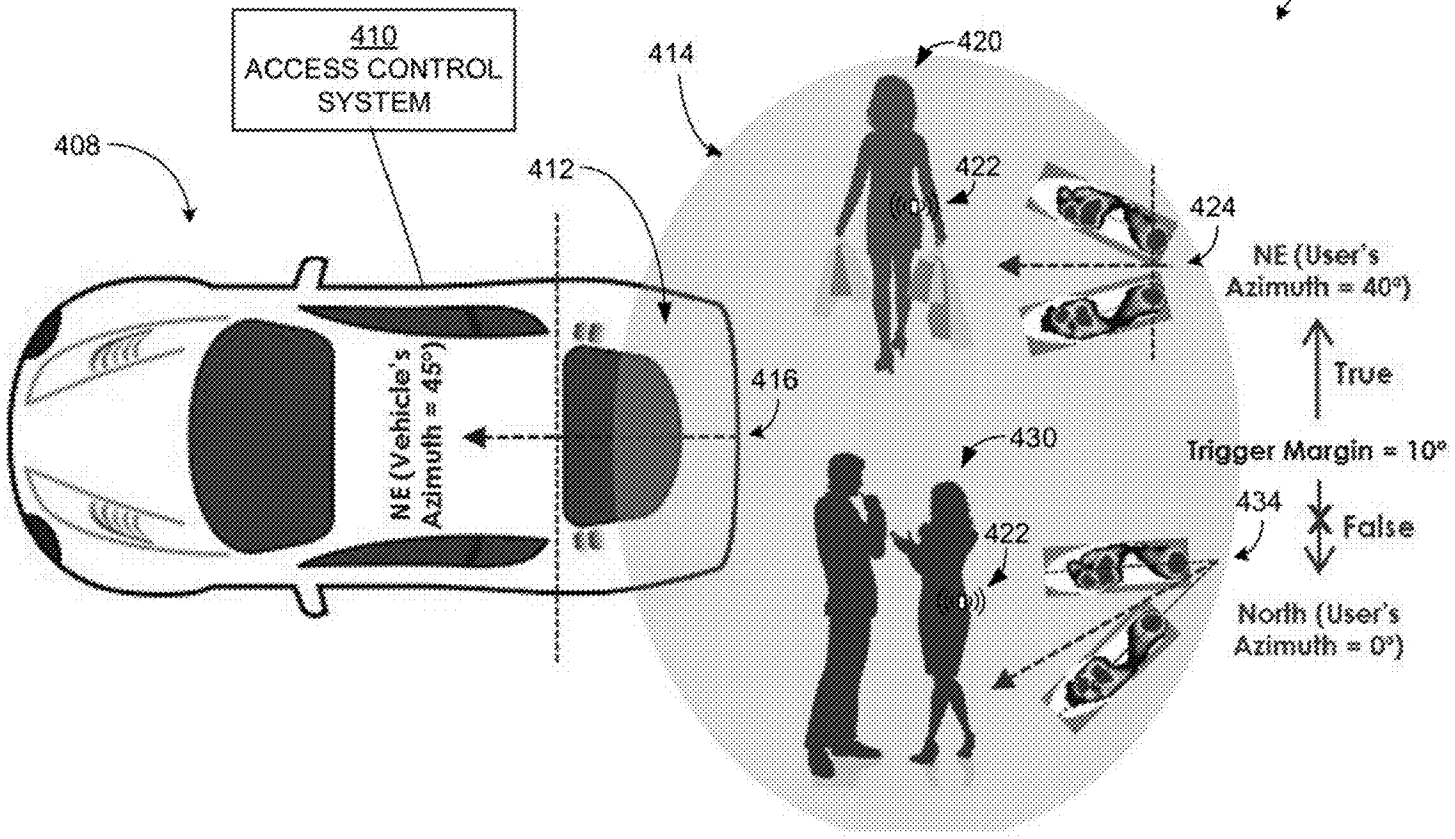
FIG. 4 illustrates an example diagram where sensed orientation parameters may be used to guide the activation of a vehicle trunk.

FIG. 4 illustrates an example diagram 400 where sensed orientation parameters may be used to guide the activation of a vehicle trunk, arranged in accordance with at least some embodiments described herein.

According to the diagram 400, a vehicle 408 may have an associated storage compartment or trunk 412. The vehicle 408 may implement an access control system 410, such as the access control system 310, configured to actuate the trunk 412 in response to (a) determining that a proximity UI device, such as the proximity UI device 352, is within an activation area 414 within proximity of the vehicle 408, and (b) that a sensed orientation parameter associated with the proximity UI device or a user associated with the proximity UI device is sufficiently similar to a vehicle orientation parameter 416, which for illustrative purposes may correspond to an orientation or azimuth of 45°, or approximately north-east. In some embodiments, the access control system 410 may measure the vehicle orientation parameter 416 using one or more sensors, such as the sensors 318.

For example, a user 420 with the proximity UI device 422 may intend to load items into the trunk 412. The user 420 may enter the area 414 and stand in front of and facing the trunk 412 and therefore the vehicle 408. The access control system 410 may then determine that the proximity UI device 422 is within the activation area 414, for example using a proximity UI device detector such as the proximity UI device detector 320. Moreover, the access control system 410 may also receive an orientation parameter 424 associated with the user 420 and/or the proximity UI device 422, which for illustrative purposes may correspond to an orientation or azimuth of 40°, also approximately north-east. For example, a user access system such as the user access system 350 may measure the orientation parameter 424 using sensors such as the foot sensors 356, the other sensors 358, and/or the sensors 362 associated with the mobile device 360. The user access system may then transmit the orientation parameter 424 to the access control system 410.

The access control system 410 may then determine whether the received orientation parameter 424 is sufficiently similar to the vehicle orientation parameter 416. In some embodiments, the access control system 410 may determine similarity based on a trigger margin or activation threshold. The access control system 410 may determine that the received orientation parameter 424 is sufficiently similar to the vehicle orientation parameter 416 if the difference between the received orientation parameter 424 and the vehicle orientation parameter 416 is less than or equal to the trigger margin or activation threshold, which in this example may span a range of 10°, centered around the vehicle orientation parameter 416. Because the received orientation parameter 424 differs from the vehicle orientation parameter 416 by 5°, which is equal to half of the trigger margin or activation threshold of 10°, the access control system 410 may determine that the two orientation parameters 424 and 416 are sufficiently similar. As a result of determining that the proximity UI device 422 is within the activation area 414 and the received orientation parameter 424 is sufficiently similar to the vehicle orientation parameter 416, then access control system 410 may actuate the trunk 412.

As another example, a user 430 with the proximity UI device 432 may be within the activation area 414, but may not intend to operate the trunk 412 and may instead be engaged in some other activity. In this situation, the access control system 410 may determine that the proximity UI device 432 is within the activation area 414, and may also receive an orientation parameter 434 associated with the user 430 and/or the proximity UI device 432, which for illustrative purposes may correspond to an azimuth of 0°, or approximately north. The access control system 410 may then determine whether the received orientation parameter 434 is sufficiently similar to the vehicle orientation parameter 416. Because the received orientation parameter 434 differs from the vehicle orientation parameter by 45°, which is more than half the trigger margin or activation threshold of 10°, the access control system 410 may determine that the two orientation parameters 434 and 416 are not sufficiently similar. As a result, the access control system 410 may not actuate the trunk 412, even though the proximity UI device 432 is within the activation area 414.

Figure 5:
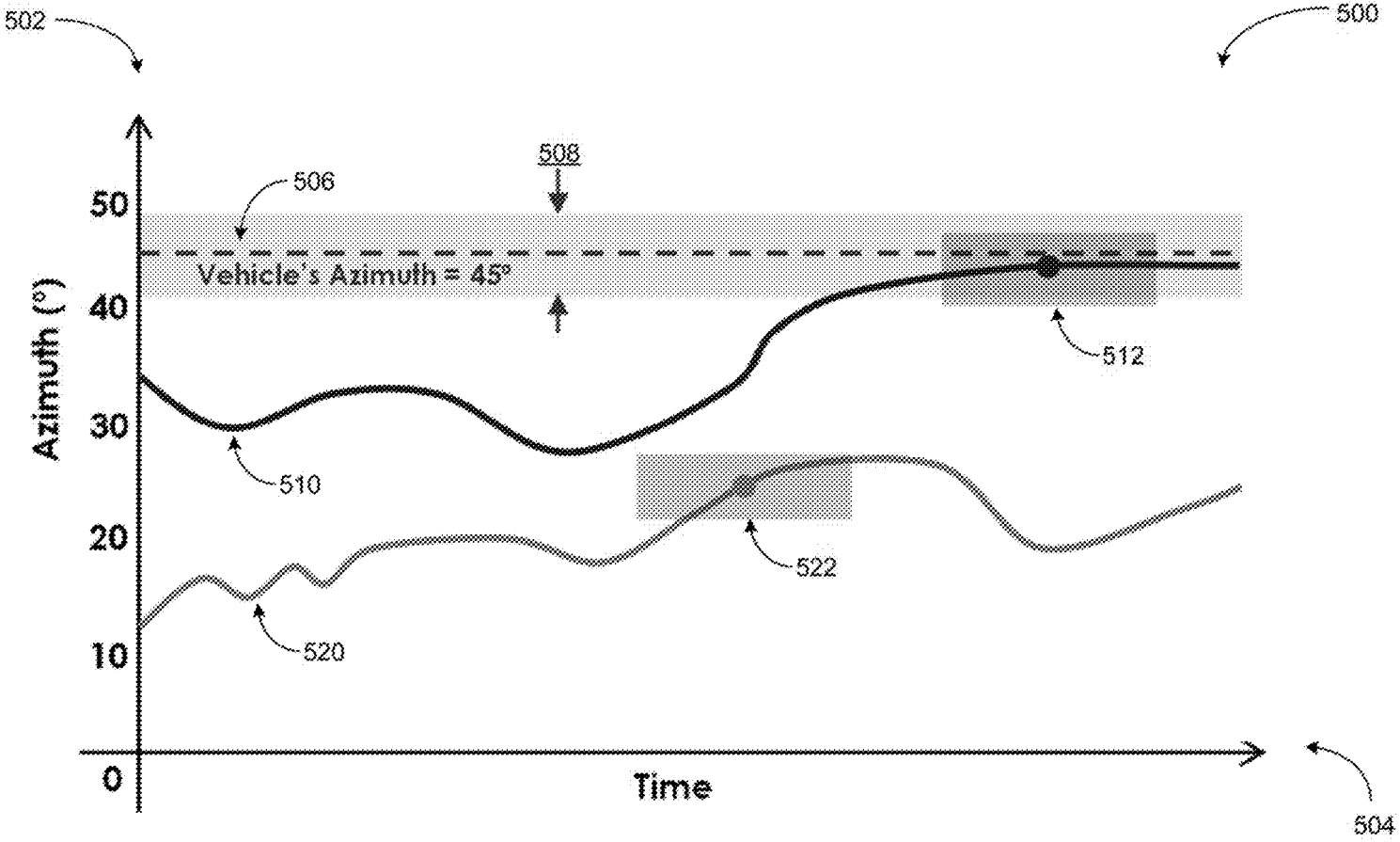
FIG. 5 depicts how sensed orientation parameters over time may be used to determine whether a vehicle door or trunk is to be activated.

FIG. 5 depicts how sensed orientation parameters over time may be used to determine whether a vehicle door or trunk is to be activated, arranged in accordance with at least some embodiments described herein.

As described above, an access control system or an actuator controller associated with a vehicle may determine the similarity of a received orientation parameter and a vehicle orientation parameter based whether a difference between the two orientation parameters satisfies a trigger margin or activation threshold. The vehicle may then use the determined similarity to determine whether a vehicle storage compartment or door should be actuated. In some embodiments, a vehicle may determine similarity by using a moving average technique for a time duration. A chart 500 depicts the azimuth or orientation value (indicated by an azimuth axis 502) of three orientation parameters 506, 510, and 520 over time (indicated by a time axis 504). The orientation parameter 506 may represent the azimuth or orientation of a vehicle, such as the vehicle 408, over time, and may remain relatively unchanging at a value of 45° for illustrative purposes. The orientation parameters 510 and 520 may represent the azimuth or orientation of a user and/or a proximity UI device, such as the users 420/430 and/or the proximity UI devices 422/432, and may change over time as the user and/or proximity UI device move.

In some embodiments, the orientation parameter 510 may represent the orientation of a user intending to access a trunk of the vehicle, such as the user 420, whereas the orientation parameter 520 may represent the orientation of a user within proximity of the vehicle but not intending to access the trunk of the vehicle, such as the user 430. As depicted in the chart 500, the value of the orientation parameter 510 approaches that of the orientation parameter 506 of the vehicle over time. At some point, the value of the orientation parameter 510 falls within a trigger margin or activation threshold 508 associated with the orientation parameter 506 of the vehicle, which in this example may span 5° above and below the orientation parameter 506 of the vehicle, similar to the situation depicted in FIG. 4. In order to avoid unintended actuation of the vehicle trunk due to false triggers, the access control system may not use instantaneous values of the orientation parameter 510 (for example, the value of the orientation parameter 510 at a particular point in time) to determine whether the orientation parameter 510 is sufficiently similar to the vehicle orientation parameter 506. Instead, the access control system may use values of the orientation parameter 510 averaged over a particular time duration. For example, the access control system may average the sensed or received values of the orientation parameter 510 during a moving time window 512. If the values of the orientation parameter 510 averaged during the time window 512 satisfy the activation threshold 508, the access control system may actuate the vehicle trunk, assuming that a proximity UI device is also within an activation area (for example, the activation area 414) of the vehicle. The length of the time window 512 may be preset (for example, three seconds), or may be dynamically determined based on internal and/or external factors (for example, an identifier associated with the proximity UI device, a time of day, a vehicle location, a vehicle orientation, a previously-determined user preference, etc.).

In another embodiment, the orientation parameter 520 may represent the orientation of a user, such as the user 430, in proximity to the vehicle but not intending to access the trunk of the vehicle. As depicted in the chart 500, the value of the orientation parameter 520 approaches that of the vehicle orientation parameter 506, but may not fall within or satisfy the activation threshold 508. Accordingly, even if a proximity UI device is within the activation area of the vehicle, the access control system may not actuate the vehicle trunk based on the orientation parameter 520. Moreover, even if the value of the orientation parameter 520 were to momentarily fall within the activation threshold 508, the access control system may not actuate the vehicle trunk unless the averaged values of the orientation parameter 520 during a moving time window (e.g., time window 522) satisfy the activation threshold.

Figure 6:
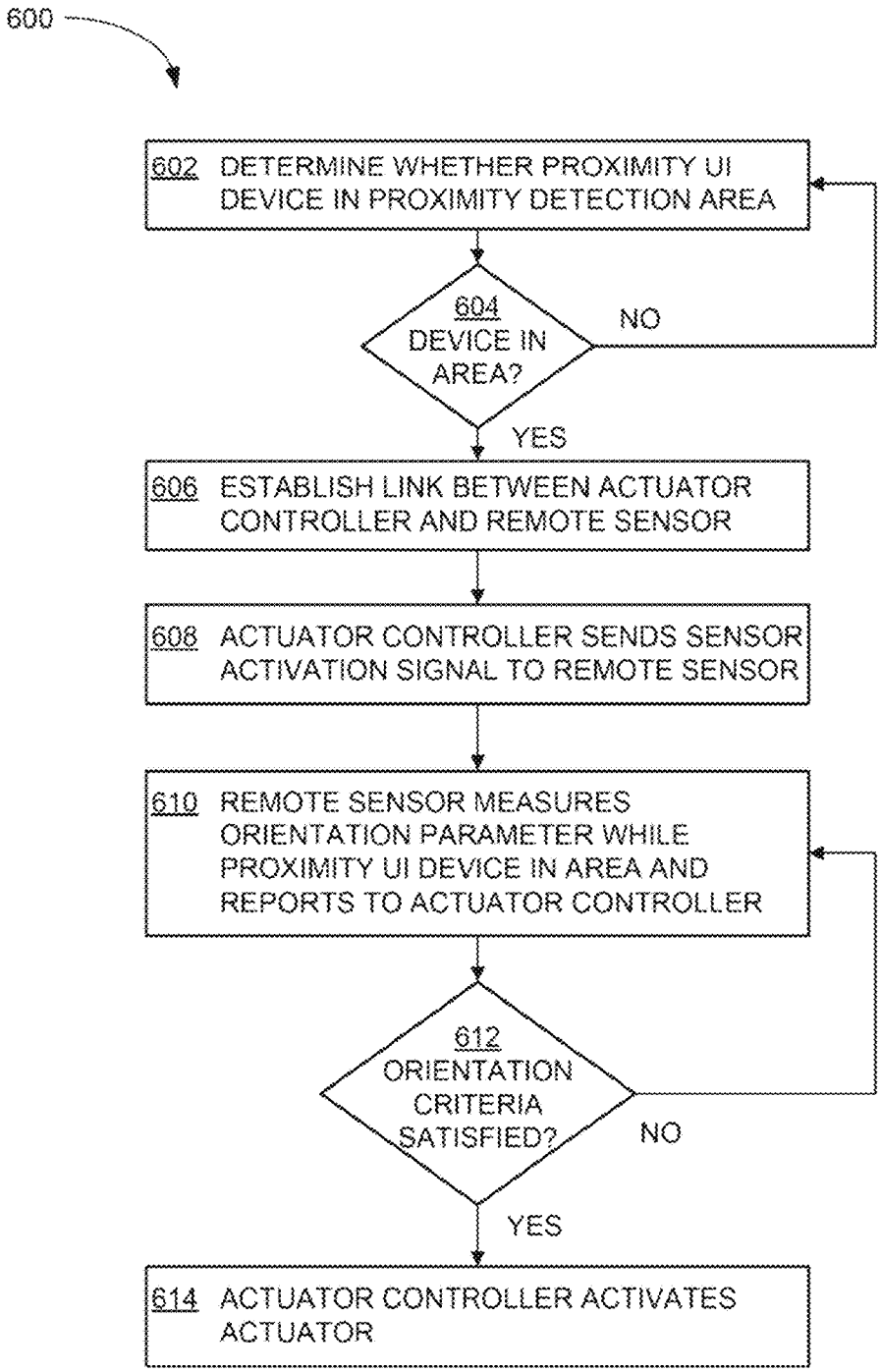
FIG. 6 is a flow diagram illustrating an example process to activate an actuator based on sensed orientation parameters.

FIG. 6 is a flow diagram illustrating an example process 600 to activate an actuator based on sensed orientation parameters, arranged in accordance with at least some embodiments described herein.

Process 600 may include one or more operations, functions, or actions as illustrated by one or more of blocks 602-614. Although some of the blocks in process 600 (as well as in any other process/method disclosed herein) are illustrated in a sequential order, these blocks may also be performed in parallel, and/or in a different order than those described herein. In addition, the various blocks may be combined into fewer blocks, divided into additional blocks, and/or eliminated based upon the particular implementation. Additional blocks representing other operations, functions, or actions may be provided.

According to process 600, activation of an actuator may begin at block 602, "DETERMINE WHETHER PROXIMITY UI DEVICE IN PROXIMITY DETECTION AREA", where an actuator controller may determine whether a proximity UI device, such as the proximity UI device 352, is present within a proximity detection area (for example, the activation area 414). In some embodiments, the actuator controller may perform the determination based on whether the proximity UI device is detected by a proximity UI device detector, such as the proximity UI device detector 320. At block 604, "DEVICE IN AREA?", which may follow block 602, if the actuator controller determines that the proximity UI device is not in the proximity area, the actuator controller may return to block 602. On the other hand, if the actuator controller determines at block 604 that the proximity UI device is in the proximity area, at block 606, "ESTABLISH LINK BETWEEN ACTUATOR CONTROLLER AND REMOTE SENSOR", which may follow block 604, the actuator controller may establish a connection to a remote sensor configured to measure an orientation parameter associated with the proximity UI device and/or a user of the proximity UI device, such as the foot sensors 356, the other sensors 358, and/or the sensors 362. The connection may be via a wireless connection, as described above. In some embodiments, the actuator controller may establish the connection via a controller of a user access system, such as the controller 354.

At block 608, "ACTUATOR CONTROLLER SENDS SENSOR ACTIVATION SIGNAL TO REMOTE SENSOR", which may follow block 606, the actuator controller may transmit an activation signal to the remote sensor configured to cause the remote sensor to begin sensing an orientation of the user or the proximity UI device. At block 610, "REMOTE SENSOR MEASURES ORIENTATION WHILE PROXIMITY UI DEVICE IN AREA AND REPORTS TO ACTUATOR CONTROLLER", which may follow block 608, the remote sensor may begin measuring an orientation parameter associated with the user and/or the proximity UI device while the proximity UI device remains in the proximity area, and may report the measured orientation parameter to the actuator controller. In some embodiments, the remote sensor may continuously or periodically measure the orientation parameter without receiving an activation signal or even while the proximity UI device is not in the proximity area.

At block 612, "ORIENTATION CRITERIA SATISFIED?", which may follow block 610, the actuator controller may compare the remote orientation parameter data received from the remote sensor to local orientation parameter data (for example, sensed via the sensors 318), as described above in FIG. 5. If the remote orientation parameter data and the local orientation parameter data are significantly different (for example, they do not fall within a trigger margin or activation threshold with respect to each other for a particular time window), the actuator controller may return to block 610.

On the other hand, the actuator controller may determine at block 612 that the remote orientation parameter data and the local orientation parameter data are substantially similar (for example, they do fall within a trigger margin or activation threshold with respect to each other for a particular time window). If so, then at block 614, "ACTUATOR CONTROLLER ACTIVATES ACTUATOR", which may follow block 612, the actuator controller may activate an actuator such as the actuator 314, which in turn may activate a container or entryway such as the container/entryway 312. For example, the actuator 314 may open, close, unlock, and/or lock the container or entryway.

Figure 7:
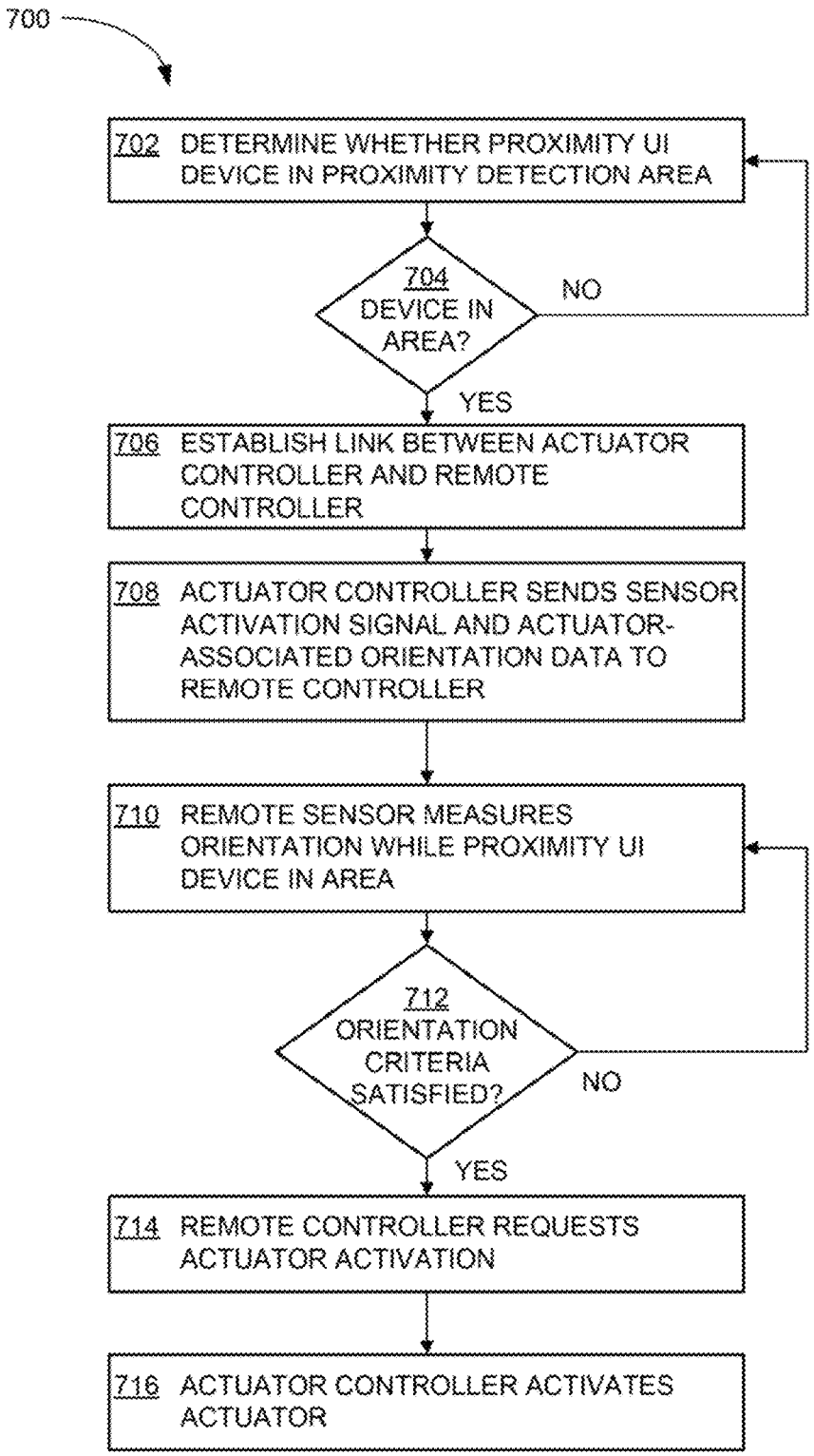
FIG. 7 is a flow diagram illustrating another example process to activate an actuator based on sensed orientation parameters.

FIG. 7 is a flow diagram illustrating another example process 700 to activate an actuator based on sensed orientation parameters, arranged in accordance with at least some embodiments described herein.

Process 700 may include one or more operations, functions, or actions as illustrated by one or more of blocks 702-716. Although some of the blocks in process 700 (as well as in any other process/method disclosed herein) are illustrated in a sequential order, these blocks may also be performed in parallel, and/or in a different order than those described herein. Also, the various blocks may be combined into fewer blocks, divided into additional blocks, and/or eliminated based upon the particular implementation. Additional blocks representing other operations, functions, or actions may be provided.

According to process 700, activation of an actuator may begin at block 702, "DETERMINE WHETHER PROXIMITY UI DEVICE IN PROXIMITY DETECTION AREA", where an actuator controller may determine whether a proximity UI device, such as the proximity UI device 352, is present within a proximity detection area (for example, the activation area 414). In some embodiments, the actuator controller may perform the determination based on whether the proximity UI device is detected by a proximity UI device detector, such as the proximity UI device detector 320. At block 704, "DEVICE IN AREA?", which may follow block 702, if the actuator controller determines that the proximity UI device is not in the proximity area, the actuator controller may return to block 702. On the other hand, if the actuator controller determines at block 704 that the proximity UI device is in the proximity area, at block 706, "ESTABLISH LINK BETWEEN ACTUATOR CONTROLLER AND REMOTE CONTROLLER", which may follow block 704, the actuator controller may establish a connection to a remote controller of a user access system, such as the controller 354.

At block 708, "ACTUATOR CONTROLLER SENDS SENSOR ACTIVATION SIGNAL AND ACTUATOR-ASSOCIATED ORIENTATION DATA TO REMOTE CONTROLLER", which may follow block 706, the actuator controller may transmit an activation signal to the remote controller requesting activation of a remote sensor configured to measure an orientation parameter associated with the proximity UI device and/or a user of the proximity UI device, such as the foot sensors 356, the other sensors 358, and/or the sensors 362. The remote sensor, once activated, may begin sensing an orientation of the user or the proximity UI device. The actuator controller may also send local orientation parameter data (for example, sensed via the sensors 318) to the remote controller. At block 710, "REMOTE SENSOR MEASURES ORIENTATION WHILE PROXIMITY UI DEVICE IN AREA", which may follow block 708, the remote sensor may begin measuring an orientation parameter associated with the user and/or the proximity UI device while the proximity UI device remains in the proximity area. In some embodiments, the remote sensor may continuously or periodically measure the orientation parameter without requiring activation or even while the proximity UI device is not in the proximity area.

At block 712 "ORIENTATION CRITERIA SATISFIED?", which may follow block 710, the remote controller may compare the remote orientation parameter data from the remote sensor to the local orientation parameter data received from the actuator controller at block 708, as described above in FIG. 5. If the remote orientation parameter data and the local orientation parameter data are significantly different (for example, they do not fall within a trigger margin or activation threshold with respect to each other for a particular time window), the remote controller may return to block 710.

On the other hand, the remote controller may determine at block 712 that the remote orientation parameter data and the local orientation parameter data are substantially similar (for example, they do fall within a trigger margin or activation threshold with respect to each other for a particular time window). If so, then at block 714, "REMOTE CONTROLLER REQUESTS ACTUATOR ACTIVATION", which may follow block 712, the remote controller may transmit an actuator activation signal to the actuator controller. At block 716, "ACTUATOR CONTROLLER ACTIVATES ACTUATOR", which may follow block 714, the actuator controller may then activate an actuator such as the actuator 314 in response to the actuator activation request at block 714, which in turn may activate a container or entryway such as the container/entryway 312. For example, the actuator 314 may open, close, unlock, and/or lock the container or entryway.

Figure 8:
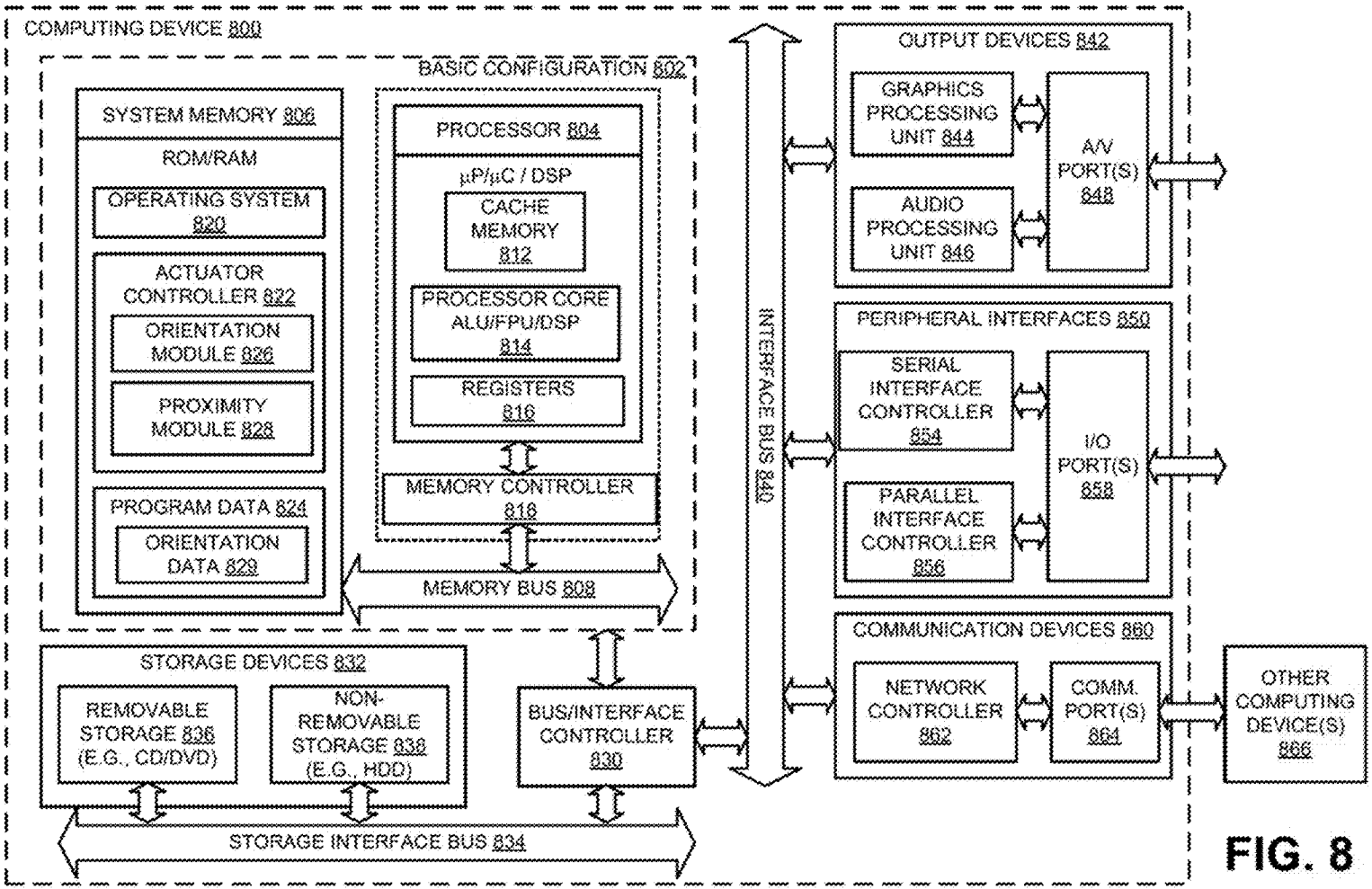
FIG. 8 illustrates a general purpose computing device, which may be used to provide actuator activation based on sensed user characteristics.

FIG. 8 illustrates a general purpose computing device 800, which may be used to provide actuator activation based on sensed user characteristics, arranged in accordance with at least some embodiments described herein.

For example, the computing device 800 may be used to activate actuators based on sensed orientation parameters as described herein. In an example basic configuration 802, the computing device 800 may include one or more processors 804 and a system memory 806. A memory bus 808 may be used to communicate between the processor 804 and the system memory 806. The basic configuration 802 is illustrated in FIG. 8 by those components within the inner dashed line.

Depending on the desired configuration, the processor 804 may be of any type, including but not limited to a microprocessor (μP), a microcontroller (μC), a digital signal processor (DSP), or any combination thereof. The processor 804 may include one more levels of caching, such as a cache memory 812, a processor core 814, and registers 816. The example processor core 814 may include an arithmetic logic unit (ALU), a floating point unit (FPU), a digital signal processing core (DSP Core), or any combination thereof. An example memory controller 818 may also be used with the processor 804, or in some implementations, the memory controller 818 may be an internal part of the processor 804.

Depending on the desired configuration, the system memory 806 may be of any type including but not limited to volatile memory (such as RAM), non-volatile memory (such as ROM, flash memory, etc.) or any combination thereof. The system memory 806 may include an operating system 820, an actuator controller 822, and program data 824. The actuator controller 822 may include an orientation module 826 to determine actuator orientation, sensor orientation, and/or orientation differences as described herein, and may also include a proximity module 828 to determine the proximity of a proximity UI device as described herein. The program data 824 may include, among other data, orientation data 829 or the like, as described herein.

The computing device 800 may have additional features or functionality, and additional interfaces to facilitate communications between the basic configuration 802 and any desired devices and interfaces. For example, a bus/interface controller 830 may be used to facilitate communications between the basic configuration 802 and one or more data storage devices 832 via a storage interface bus 834. The data storage devices 832 may be one or more removable storage devices 836, one or more non-removable storage devices 838, or a combination thereof. Examples of the removable storage and the non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

The system memory 806, the removable storage devices 836 and the non-removable storage devices 838 are examples of computer storage media. Computer storage media includes, but is not limited to, RAM, ROM, EEPROM, flash memory or other memory technology, CD-ROM, digital versatile disks (DVD), solid state drives, or other optical storage, magnetic cassettes, magnetic tape, magnetic disk storage or other magnetic storage devices, or any other medium which may be used to store the desired information and which may be accessed by the computing device 800. Any such computer storage media may be part of the computing device 800.

The computing device 800 may also include an interface bus 840 for facilitating communication from various interface devices (e.g., one or more output devices 842, one or more peripheral interfaces 850, and one or more communication devices 860) to the basic configuration 802 via the bus/interface controller 830. Some of the example output devices 842 include a graphics processing unit 844 and an audio processing unit 846, which may be configured to communicate to various external devices such as a display or speakers via one or more A/V ports 848. One or more example peripheral interfaces 850 may include a serial interface controller 854 or a parallel interface controller 856, which may be configured to communicate with external devices such as input devices (e.g., keyboard, mouse, pen, voice input device, touch input device, etc.) or other peripheral devices (e.g., printer, scanner, etc.) via one or more I/O ports 858. An example communication device 860 includes a network controller 862, which may be arranged to facilitate communications with one or more other computing devices 866 over a network communication link via one or more communication ports 864. The one or more other computing devices 866 may include servers at a datacenter, customer equipment, and comparable devices.

The network communication link may be one example of a communication media. Communication media may be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

The computing device 800 may be implemented as a pan of a general purpose or specialized server, mainframe, or similar computer that includes any of the above functions. The computing device 800 may also be implemented as a personal computer including both laptop computer and non-laptop computer configurations.

Figure 9:
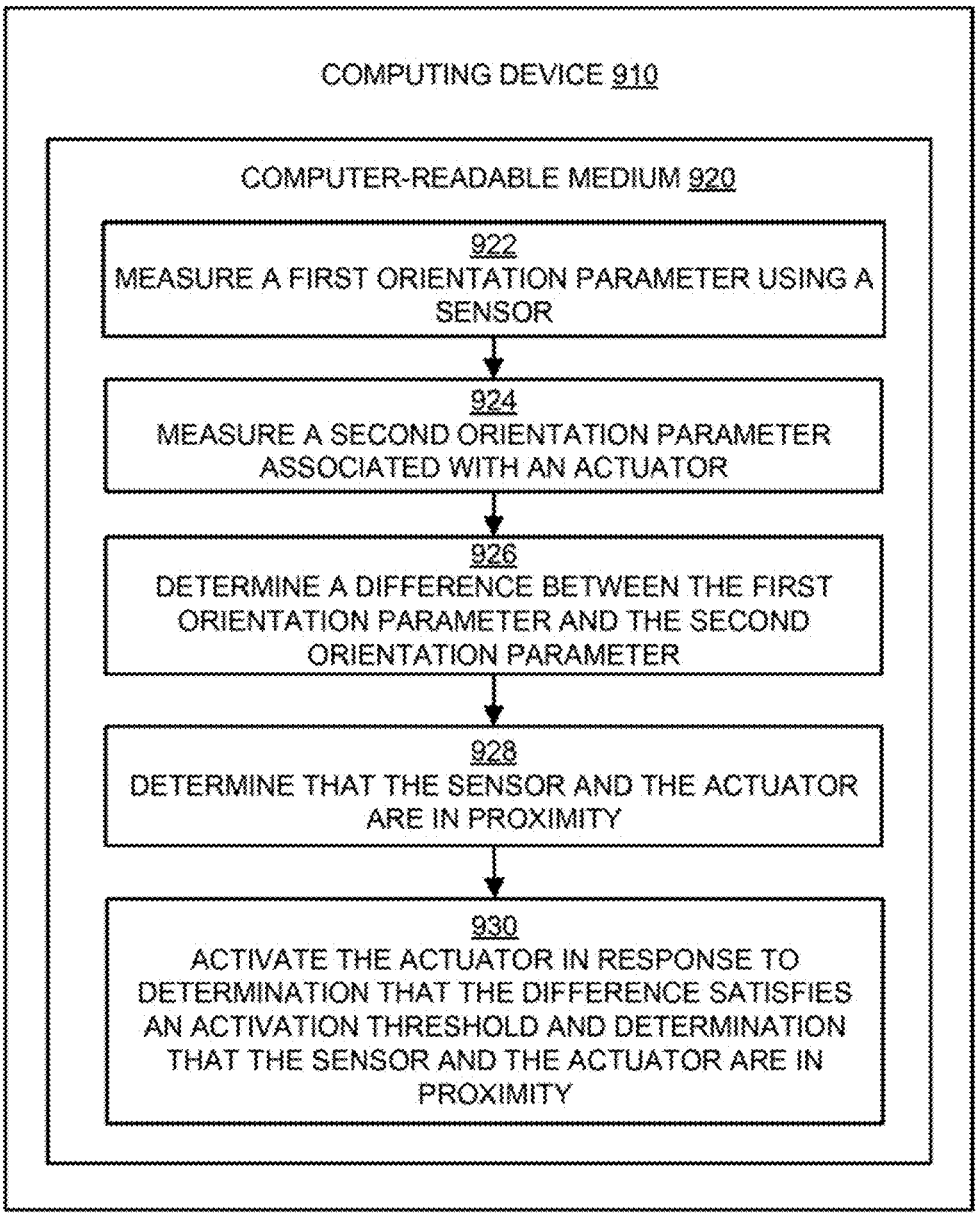
FIG. 9 is a flow diagram illustrating an example method to activate an actuator based on sensed orientation parameters that may be performed by a computing device such as the computing device in FIG. 8.

FIG. 9 is a flow diagram illustrating an example method to activate an actuator based on sensed orientation parameters that may be performed by a computing device such as the computing device in FIG. 8, arranged in accordance with at least some embodiments described herein.

Example methods may include one or more operations, functions or actions as illustrated by one or more of blocks 922, 924, 926, 928, and/or 930, and may in some embodiments be performed by a computing device such as a computing device 910 in FIG. 9, which may be similar to the computing device 800 in FIG. 8. The operations described in the blocks 922-930 may also be stored as computer-executable instructions in a computer-readable medium such as a computer-readable medium 920 of the computing device 910.

An example process to activate an actuator based on sensed orientation parameters may begin with block 922, "MEASURE A FIRST ORIENTATION PARAMETER USING A SENSOR", where a sensor associated with a user or a user access system may measure a first orientation parameter associated with the user or the user access system, as described above. The sensor may be implemented as a foot sensor, a mobile device sensor, or any other suitable sensor.

Block 922 may be followed by block 924, "MEASURE A SECOND ORIENTATION PARAMETER ASSOCIATED WITH AN ACTUATOR", where another sensor associated with an actuator (e.g., the sensors 318) may measure a second orientation parameter associated with an actuator or a vehicle or structure associated with the actuator, as described above.

Block 924 may be followed by block 926, "DETERMINE A DIFFERENCE BETWEEN THE FIRST ORIENTATION PARAMETER AND THE SECOND ORIENTATION PARAMETER", where a controller such as an actuator controller (for example, the actuator controller 316) or a remote controller (for example, the controller 354) may determine a difference between the first orientation parameter associated with the user or the user access system and the second orientation parameter associated with the actuator, as described above. In some embodiments, the controller may determine the difference using a moving average over a time duration.

Block 926 may be followed by block 928, "DETERMINE THAT THE SENSOR AND THE ACTUATOR ARE IN PROXIMITY", where the controller may determine that the remote sensor and the actuator are in proximity. In some embodiments, the controller may determine proximity based on interactions between a proximity UI device (for example, the proximity UI device 352) and a proximity UI device detector (for example, the proximity UI device detector 320), as described above.

Finally, block 928 may be followed by block 930, "ACTIVATE THE ACTUATOR IN RESPONSE TO DETERMINATION THAT THE DIFFERENCE SATISFIES AN ACTIVATION THRESHOLD AND DETERMINATION THAT THE SENSOR AND THE ACTUATOR ARE IN PROXIMITY", where the controller may be configured to activate the actuator if the difference between the first orientation parameter and the second orientation parameter satisfies an activation threshold and the sensor and the actuator are in proximity. For example, the controller may determine whether the difference between the first orientation parameter and the second orientation parameter determined at block 926 falls within a trigger margin or activation threshold, as described above. If the difference falls within the activation threshold, then the controller may consider the activation threshold satisfied. On the other hand, if the difference does not fall within the activation threshold, then the controller may not consider the activation threshold satisfied.

Figure 10:
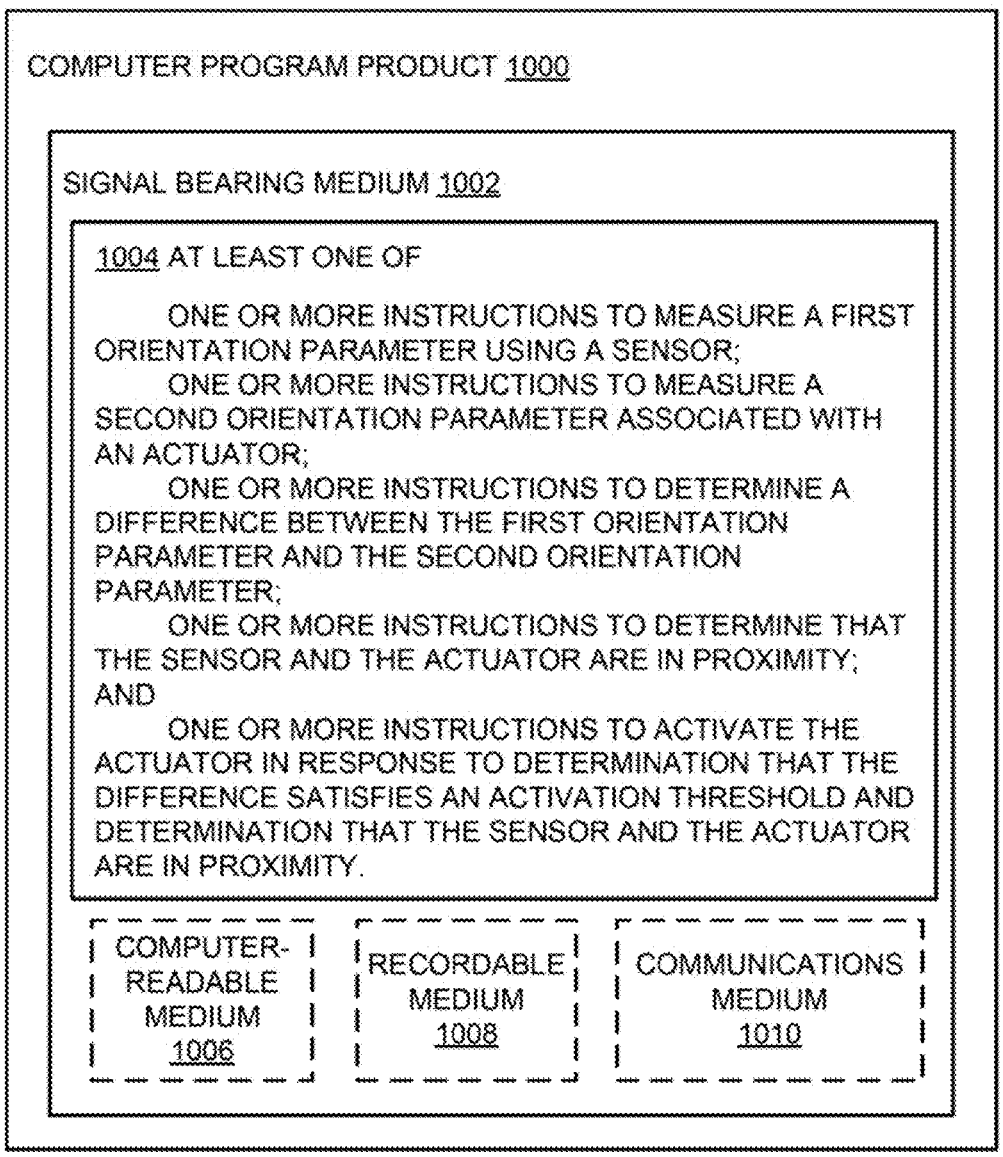
FIG. 10 illustrates a block diagram of an example computer program product, some of which are arranged in accordance with at least some embodiments described herein.

FIG. 10 illustrates a block diagram of an example computer program product, arranged in accordance with at least some embodiments described herein.

In some examples, as shown in FIG. 10, a computer program product 1000 may include a signal bearing medium 1002 that may also include one or more machine readable instructions 1004 that, when executed by, for example, a processor may provide the functionality described herein. Thus, for example, referring to the processor 804 in FIG. 8, the actuator controller 822 may undertake one or more of the tasks shown in FIG. 10 in response to the instructions 1004 conveyed to the processor 804 by the medium 1002 to perform actions associated with activating actuators based on sensed user characteristics as described herein. Some of those instructions may include, for example, instructions to measure a first orientation parameter using a sensor, measure a second orientation parameter associated with an actuator, determine a difference between the first orientation parameter and the second orientation parameter, determine that the sensor and the actuator are in proximity, and/or activate the actuator in response to determination that the difference satisfies an activation threshold and determination that the sensor and the actuator are in proximity, according to some embodiments described herein.

In some implementations, the signal bearing media 1002 depicted in FIG. 10 may encompass computer-readable media 1006, such as, but not limited to, a hard disk drive, a solid state drive, a compact disk (CD), a digital versatile disk (DVD), a digital tape, memory, etc. In some implementations, the signal bearing media 1002 may encompass recordable media 1007, such as, but not limited to, memory, read/write (R/W) CDs, R/W DVDs, etc. In some implementations, the signal bearing media 1002 may encompass communications media 1010, such as, but not limited to, a digital and/or an analog communication medium (e.g., a fiber optic cable, a waveguide, a wired communications link, a wireless communication link, etc.). Thus, for example, the program product 1000 may be conveyed to one or more modules of the processor 804 by an RF signal bearing medium, where the signal bearing media 1002 is conveyed by the wireless communications media 1010 (e.g., a wireless communications medium conforming with the IEEE 802.11 standard).

According to some examples, a method is provided to activate an opening mechanism. The method may include measuring a first orientation parameter using a sensor, measuring a second orientation parameter associated with the opening mechanism, and determining a difference between the first orientation parameter and the second orientation parameter. The method may further include determining that the sensor and the opening mechanism are in proximity and activating the opening mechanism in response to determination that the difference satisfies an activation threshold and determination that the sensor and the opening mechanism are in proximity.

According to some embodiments, the sensor may be a foot sensor and the first orientation parameter may be associated with an orientation of the foot sensor. In some embodiments, the sensor may be implemented in a mobile device and the first orientation parameter may be associated with an orientation of a user of the mobile device. Measuring the first orientation parameter may include determining an orientation of the sensor using a moving average technique for a time duration. Measuring the second orientation parameter may include measuring the second orientation parameter based on a digital compass and/or a magnetometer associated with the opening mechanism. Determining that the sensor and the opening mechanism are in proximity may include determining that a proximity UI device is within detection range of a proximity UI device detector associated with the opening mechanism. The opening mechanism may be configured to open a car tailgate, a car trunk, a car door, and/or a building entry door.

According to other examples, an actuator activation system is provided to activate an actuator based on sensed orientation parameters. The system may include an actuator, an interface configured to communicate with a sensor, and a processor block coupled to the actuator and the interface. The processor block may be configured to receive a first orientation parameter from the sensor, measure a second orientation parameter associated with the actuator, and determine a difference between the first orientation parameter and the second orientation parameter. The processor block may be further configured to determine that the sensor and the actuator are in proximity and activate the actuator in response to determination that the difference satisfies an activation threshold and determination that the sensor and the actuator are in proximity.

According to some embodiments, the sensor may be a foot sensor and/or implemented in a mobile device, and the first orientation parameter may be associated with an orientation of the foot sensor and/or an orientation of a user of the mobile device. The system may further include a digital compass and/or a magnetometer, and the processor block may be configured to measure the second orientation parameter based on the digital compass and/or the magnetometer. The system may further include a proximity UI device detector, and the processor block may be configured to determine that the sensor and the actuator are in proximity based on a determination that a proximity UI device is within detection range of the proximity UI device detector. In some embodiments, the actuator may be an opening mechanism for an entryway and/or a container. The entryway may be a car door and the container may be a car trunk. The interface may be a wireless interface configured to receive a wireless signal from the sensor.

According to further examples, another actuator activation system is provided to activate an actuator based on sensed orientation parameters. The system may include an interface configured to communicate with an actuator controller, a sensor configured to measure a first orientation parameter associated with the sensor, and a processor block coupled to the interface and the sensor. The processor block may be configured to receive a proximity detection signal from the actuator controller, receive a second orientation parameter from the actuator controller, and determine a difference between the first orientation parameter and the second orientation parameter. The processor block may be further configured to transmit an activation signal to the actuator controller in response to receiving the proximity detection signal and determination that the difference satisfies an activation threshold.

According to some embodiments, the sensor may be a foot sensor and the first orientation parameter may be associated with an orientation of the foot sensor. In some embodiments, the sensor may be implemented in a mobile device and the first orientation parameter may be associated with an orientation of a user of the mobile device. The sensor may be configured to measure the first orientation parameter using a moving average technique for a time duration. The actuator controller may be configured to open an entryway and/or a container. The entryway may be a car door and the container may be a car trunk. In some embodiments, the interface may be a wireless interface configured to receive a wireless signal from the actuator controller.

There is little distinction left between hardware and software implementations of aspects of systems; the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via application specific integrated circuits (ASICs), field programmable gate arrays (FPGAs), digital signal processors (DSPs), or other integrated formats. However, those skilled in the art will recognize that some aspects of the embodiments disclosed herein, in whole or in part, may be equivalently implemented in integrated circuits, as one or more computer programs executing on one or more computers (e.g., as one or more programs executing on one or more computer systems), as one or more programs executing on one or more processors (e.g., as one or more programs executing on one or more microprocessors), as firmware, or as virtually any combination thereof, and that designing the circuitry and/or writing the code for the software and/or firmware would be well within the skill of one of skill in the art in light of this disclosure.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a compact disk (CD), a digital versatile disk (DVD), a digital tape, a computer memory, a solid state drive, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a data processing system may include one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity of gantry systems; control motors to move and/or adjust components and/or quantities).

A data processing system may be implemented utilizing any suitable commercially available components, such as those found in data computing/communication and/or network computing/communication systems. The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to activate an opening mechanism, the method comprising:

receiving, over a wireless network, a first orientation parameter that indicates an orientation measured by a sensor;

measuring a second orientation parameter associated with the opening mechanism;

determining a difference between the first orientation parameter and the second orientation parameter;

determining that the sensor and the opening mechanism are in proximity; and in response to determination that the difference satisfies an activation threshold and determination that the sensor and the opening mechanism are in proximity, activating the opening mechanism.

2. The method of claim 1, wherein the sensor is a foot sensor and the first orientation parameter is associated with an orientation of the foot sensor.

3. The method of claim 1, wherein the sensor is implemented in a mobile device and the first orientation parameter is associated with an orientation of a user of the mobile device.

4. The method of claim 1, wherein measuring the first orientation parameter comprises determining an orientation of the sensor using a moving average technique for a time duration.

5. The method of claim 1, wherein measuring the second orientation parameter comprises measuring the second orientation parameter based on one or more of a digital compass and a magnetometer associated with the opening mechanism.

6. The method of claim 1, wherein determining that the sensor and the opening mechanism are in proximity comprises determining that a proximity UI device is within detection range of a proximity UI device detector associated with the opening mechanism.

7. The method of claim 1, wherein the opening mechanism is configured to open one or more of a car tailgate, a car trunk, a car door, and a building entry door.

8. An actuator activation system comprising:

an actuator configured to actuate an entryway or a container;

an interface configured to communicate with a sensor; and a processor block coupled to the actuator and the interface and configured to:

receive a first orientation parameter from the sensor;

measure a second orientation parameter associated with the actuator;

determine a difference between the first orientation parameter and the second orientation parameter;

determine that the sensor and the actuator are in proximity; and in response to determination that the difference satisfies an activation threshold and determination that the sensor and the actuator are in proximity, activate the actuator.

9. The system of claim 8, wherein:

the sensor is one or more of a foot sensor and implemented in a mobile device; and the first orientation parameter is associated with one or more of an orientation of the foot sensor and an orientation of a user of the mobile device.

10. The system of claim 8, further comprising one or more of a digital compass and a magnetometer, and wherein the processor block is configured to measure the second orientation parameter based on one or more of the digital compass and the magnetometer.

11. The system of claim 8, further comprising a proximity UI device detector, wherein the processor block is configured to determine that the sensor and the actuator are in proximity based on a determination that a proximity UI device is within detection range of the proximity UI device detector.

12. The system of claim 8, wherein the actuator is an opening mechanism for one or more of the entryway and the container.

13. The system of claim 12, wherein the entryway is a car door and the container is a car trunk.

14. The system of claim 8, wherein the interface is a wireless interface configured to receive a wireless signal from the sensor.

15. An actuator activation system comprising:

an interface configured to communicate with an actuator controller, wherein the actuator controller is configured to activate an actuator to an entryway or a container;

a sensor configured to measure a first orientation parameter associated with the sensor; and a processor block coupled to the interface and the sensor and configured to:

receive a proximity detection signal from the actuator controller;

receive a second orientation parameter from the actuator controller;

determine a difference between the first orientation parameter and the second orientation parameter; and in response to receiving the proximity detection signal and determination that the difference satisfies an activation threshold, transmit an activation signal to the actuator controller, wherein the activation signal causes the actuator controller to activate the actuator.

16. The system of claim 15, wherein the sensor is a foot sensor and the first orientation parameter is associated with an orientation of the foot sensor.

17. The system of claim 15, wherein the sensor is implemented in a mobile device and the first orientation parameter is associated with an orientation of a user of the mobile device.

18. The system of claim 15, wherein the sensor is configured to measure the first orientation parameter using a moving average technique for a time duration.

19. The system of claim 15, wherein the actuator controller is configured to open one or more of an entryway and a container.

20. The system of claim 19, wherein the entryway is a car door and the container is a car trunk.

21. The system of claim 15, wherein the interface is a wireless interface configured to receive a wireless signal from the actuator controller.

* * * * *